US006364520B1

(12) United States Patent
Steele

(10) Patent No.: US 6,364,520 B1
(45) Date of Patent: Apr. 2, 2002

(54) CONDUCTION MIXERS

(75) Inventor: James R. Steele, Stillwater, MN (US)

(73) Assignee: Dynamic Air Inc., St. Paul, MN (US)

( * ) Notice: Subject to any disclaimer, the term of this patent is extended or adjusted under 35 U.S.C. 154(b) by 0 days.

(21) Appl. No.: 09/591,861

(22) Filed: Jun. 12, 2000

(51) Int. Cl.[7] ..... B01F 7/04; B01F 15/06
(52) U.S. Cl. ..... 366/147; 366/325.5
(58) Field of Search ..... 360/144, 147, 360/149, 297, 325.4, 325.5, 325.92

(56) References Cited

U.S. PATENT DOCUMENTS 1,512,813 A * 10/1924 Banbury
1,881,994 A * 10/1932 Banbury
1,938,377 A * 12/1933 Ducharme et al.
1,953,295 A * 4/1934 Garbutt
2,027,185 A * 1/1936 Loomis
2,584,225 A * 2/1952 Plunguian et al.
2,624,552 A * 1/1953 Rose
2,753,159 A * 7/1956 Christian
3,020,025 A * 2/1962 O'Mara
3,090,606 A * 5/1963 Burnet
3,285,330 A * 11/1966 Root, III
3,332,368 A * 7/1967 Stickelber
3,563,710 A * 2/1971 Dew, Jr. et al.
4,040,768 A * 8/1977 Christian
4,183,674 A * 1/1980 Sudo et al. ..... 366/147
4,443,110 A * 4/1984 den Otter ..... 366/347
4,527,902 A * 7/1985 Christen ..... 366/347
4,791,735 A 12/1988 Forberg ..... 34/181
4,913,641 A * 4/1990 Zahradnik ..... 366/147
5,055,273 A * 10/1991 Wilhelm et al.
5,333,556 A * 8/1994 Isobe et al.
5,547,227 A * 8/1996 Caspellherr et al. ..... 366/146
6,105,490 A * 8/2000 Horn et al. ..... 366/147

* cited by examiner

*Primary Examiner*—Tony G. Soohoo
(74) *Attorney, Agent, or Firm*—Jacobson & Johnson

(57) ABSTRACT

A conduction mixer having a hopper for receiving a material to be mixed, a mixing member mounted in the hopper and movable in the hopper to thereby mix the material in the hopper and a source of heat transfer fluid, connected to the mixing member to direct the heat transfer fluid through the mixing member to enable the mixing member to simultaneously mix material and conductively transfer heat between the heat transfer fluid and the material to be mixed.

25 Claims, 5 Drawing Sheets

CONDUCTION MIXERS

FIELD OF THE INVENTION

This invention relates generally to mixers and more specifically to a conduction mixer and method of conduction mixing for rapidly heating or cooling materials during a mixing cycle.

BACKGROUND OF THE INVENTION

The concept of material heating and cooling devices that also mix materials is known in the art. In one type of a particulate material heating and cooling device, which is shown in the Forberg U.S. Pat. No. 4,791,735, a gas is forced down along the sides of the container and into direct contact with the materials as the materials are mixed. The gas is then allowed to discharge through a vent in the top of the mixer. This type of mixer requires capping the hopper to prevent material from being blown out of the hopper. In addition, the time required for mixing and heating or cooling a particulate material is considerable.

The present invention presents a new type of material heating and cooling device that can simultaneously mix material without having a heating or cooling gas contact the material being mixed. The present invention isolates a heat transfer fluid from the material and directs the heat transfer fluid through a shaft and a set of mixing members of the system to conductively transfer heat between the heat transfer fluid and the material to be mixed without contamination of the mixed material. In addition, the conductive heat transfer between the heat transfer fluid and the material allows one to more quickly raise or lower the temperature of the mixing material since one can provide large surface contact areas between the material to be mixed and the surfaces of the mixing members.

DESCRIPTION OF THE PRIOR ART

Forberg U.S. Pat. No. 4,791,735 shows a mixer wherein a gas is forced directly into the particulate material as the particulate material are being mixed.

SUMMARY OF THE INVENTION

A method of mixing and a conduction mixer having a hopper for receiving a material to be mixed, a mixing member mounted in the hopper and movable in the hopper to mix the material in the hopper and a source of heat transfer fluid connected to the mixing member to direct the heat transfer fluid through either or both a heat transfer jacket or the mixing member to enable the mixing member to simultaneously mix and conductively transfer heat between the heat transfer fluid and the material.

DESCRIPTION OF THE PREFERRED EMBODIMENT

Figure 1:
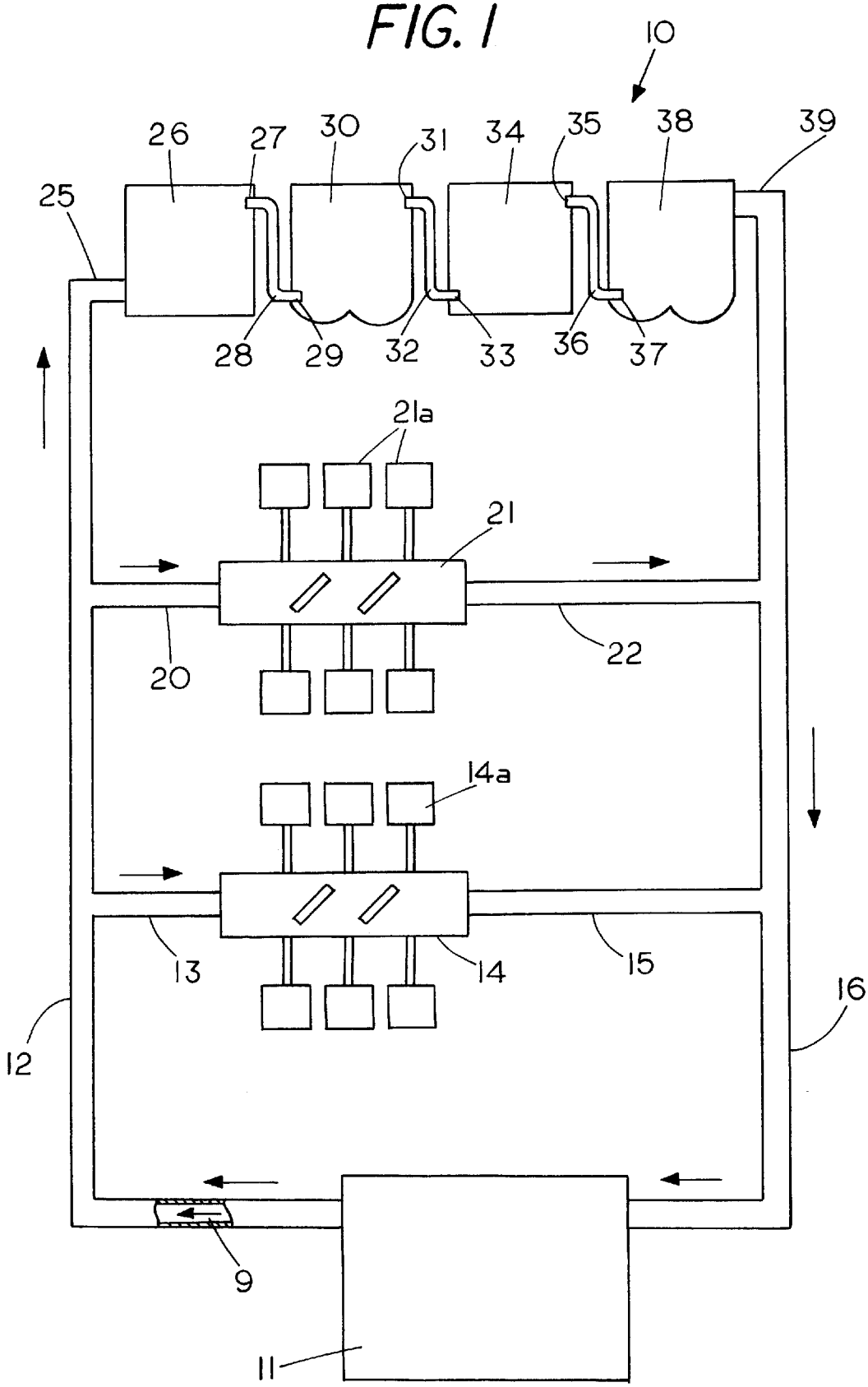
FIG. 1 shows a partial schematic view of the system for conductive transferring heat as the material is being mixed.

FIG. 1 shows a partial schematic view of a system 10 for conductively transferring heat to a material as the material is being mixed. System 10 includes a source 11 of heat transfer fluid which is maintained under pressure by a pump located in source 11. Source 11 can included heaters or coolers to provide for heating or cooling a heat transfer fluid to the proper temperature. The heat transfer fluid within system 10 comprises a liquid such as hydraulic oil, water or the like. The heat transfer fluid 9 is shown in a partial cutaway of fluid conduit 12. Generally, the liquid selected as a heat transfer fluid 9 can be any of a number of liquids as long as the liquids are compatible with the equipment in the system as well as compatible with the heating or cooling requirements of the mixing system. While system 10 could be used with heat transfer fluids such as air, liquids are preferred because liquids have greater heat capacity and thus can provide for more rapid cooling or heating of the mixed material though conduction of heat between the heat transfer fluid and the material to be mixed.

Figure 2:
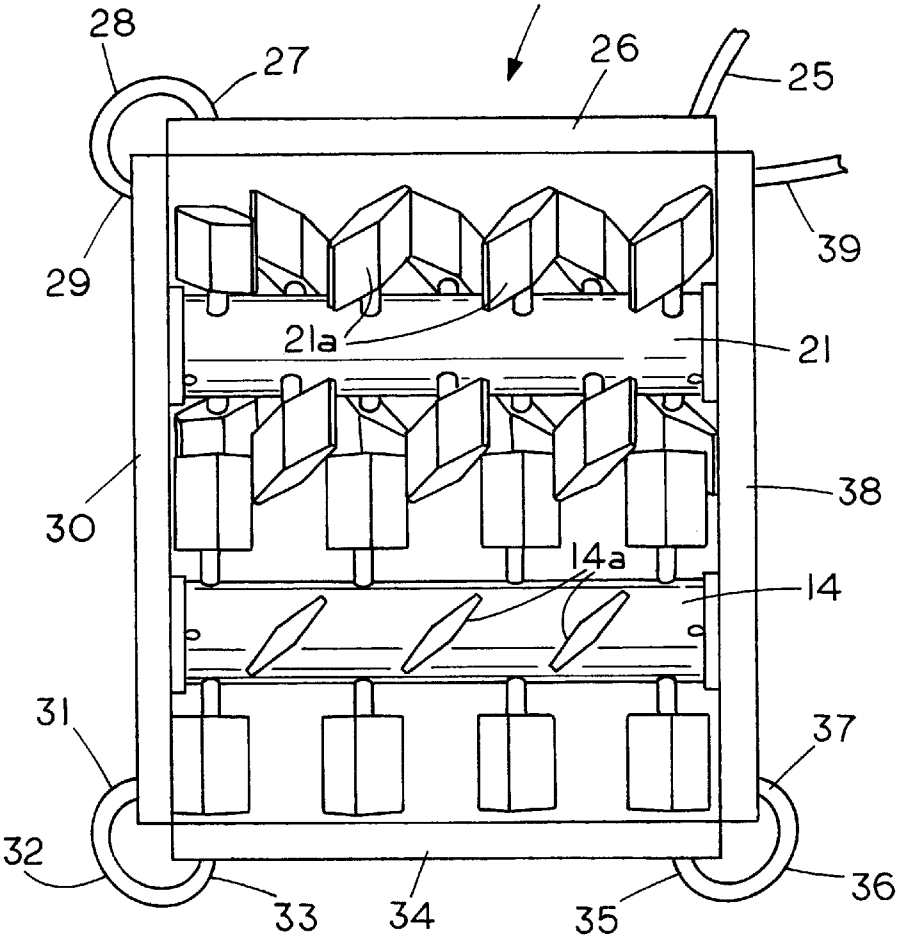
FIG. 2 is a top view of a hopper with a plurality of mixing paddles and a set of heat transfer jackets located circumferentially around the hopper.

Extending outward from source 11 of heat transfer fluid 9 is a fluid conduit 12 that connects in parallel to three different components of mixing system 10 to enable the heat transfer fluid to flow in three independent paths as it conductively heats or cools the material in a hopper. That is, fluid conduit 12 connects to a first set of mixing paddles 14*a* through one end of a shaft 14 and a fluid inlet 13 with a portion of the heat transfer fluid flowing therethrough. Similarly, fluid conduit 12 connects in parallel to a second set of mixing paddles 21*a* through one end of a shaft 21 and a fluid inlet 20 with a further portion of the heat transfer fluid flowing therethrough. Mixing paddles 14*a* and 21*a* are identical to each other; however, as can be seen in FIG. 2 the mixing paddles can be located at different angles with respect to the support shafts. Finally, fluid conduit 12 also connects in parallel to a set of heat transfer jackets 26, 30, 34 and 38 through a fluid inlet 25 with a still further portion of the heat transfer fluid 9 flowing therethrough.

Each of the heat transfer jackets 26, 30, 34 and 38 are connected to each other in a series relationship so that the same portion of heat transfer fluid must flow through each of the heat transfer jackets. That is, heat transfer jacket 26 includes a lower fluid inlet 25 and upper fluid outlet 27 with a fluid conduit 28 connecting fluid outlet 27 to fluid inlet 29 of heat transfer jacket 30, Heat transfer jacket 30 includes a fluid outlet 31. A fluid conduit 32 connects fluid outlet 31 to fluid inlet 33 of heat transfer jacket 34. Heat transfer jacket 34 includes upper fluid outlet 35 with a fluid conduit 36 connecting fluid outlet 35 to fluid inlet 37 of heat transfer jacket 38. Heat transfer jacket 38 includes an outlet 39 that connects to a fluid return conduit 16 which returns the heat transfer fluid to the source 11 of heat transfer fluid.

FIG. 1 illustrates a preferred embodiment wherein that the heat transfer fluid is forced through both the heat transfer jackets and the mixing paddles of a mixer. While system 10 illustrates the preferred system wherein both the heat transfer jackets and the mixing members are heated or cooled by the heat transfer fluid it will be understood that one having obtained knowledge of the teaching of the present invention from the applicant one could selectively supply heat transfer fluid to only the mixing members or to only the heat transfer jackets. While the heat transfer jackets are shown connected in series, if desired the heat transfer jackets could be connected to a separate source of heat transfer fluid or could also be connected in parallel to each other.

In operation of the conduction mixer system of FIG. 1 the heat transfer fluid 9 flows through the conduits in the direction as indicated by the arrows so that the heat transfer fluid 9 divides into three separate paths to simultaneously pass through the two sets of mixing paddles and the heat transfer jackets located on the hopper. The heat transfer fluid 9 flows into a fluid return line 16 which returns the heat transfer fluid 9 to source 11 where the heat transfer fluid 9 can be heated or cooled as needed.

FIG. 2 shows a top view of a hopper 50 with mixing paddles 21*a* cantileverly mounted on a shaft 21 which is rotatable mounted within hopper 50 and mixing paddles 14*a* also cantileverly mounted on a shaft 14 which is also rotatable mounted in hopper 50. The heat transfer jackets 26, 30, 34 and 38 are shown circumferentially positioned around hopper 50 with each of the heat transfer jackets serially connected to an adjacent heat transfer jackets in the manner shown in FIG. 1.

Figure 3:
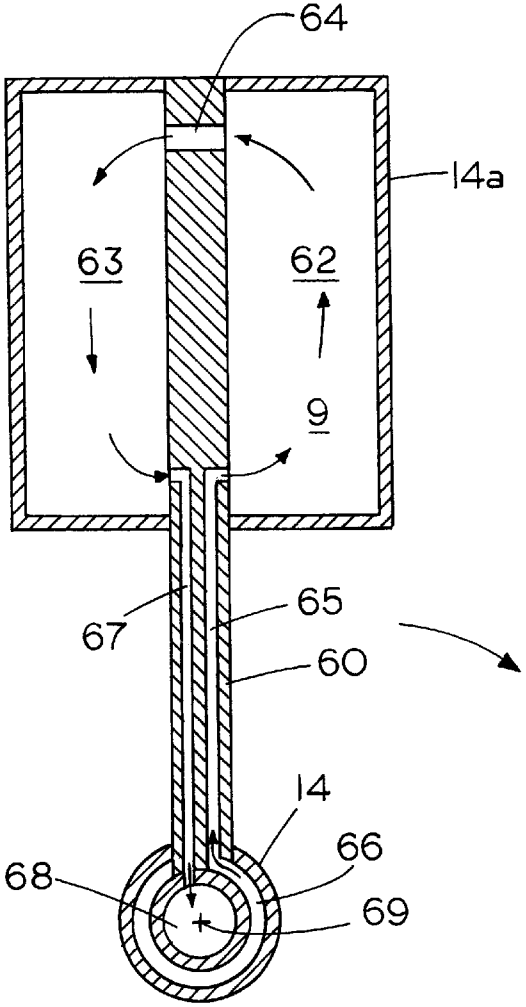
FIG. 3 is a cross sectional view of a paddle and shaft to reveal the fluid paths within the paddle and shaft.

FIG. 3 is a cross sectional view of a paddle 14*a* and shaft 14 to reveal the fluid passages within paddle 14*a* and shaft 13. Shaft 14 includes an annular fluid inlet chamber 66 that connects to chamber 62 in paddle 14*a* through a fluid passage 65 located in paddle connecting rod 60. A restriction passage 64 connects fluid chamber 62 to fluid chamber 63 which directs heat transfer fluid 9 to an outlet passage 67 located in paddle connection rod 60. The outlet passage 67 directs return heat transfer fluid 9 to a central outlet passage 68. In operation of the system, the shaft 14 and paddle 14*a* are rotated about axis 69. During the rotation of shaft 14 the heat transfer liquid 9 flows from chamber 66 into passage 65 and therein to chamber 62 where it lingers in chamber 62 to provide for conduction heat transfer through the surfaces of paddle 14*a* to the material being mixed by paddle 14*a* Thus the outer surface of paddle 14*a* makes direct contact with the material being mixed while the heat transfer fluid makes direct contact with the inside surface of paddle 21. In addition, the outer surface of shaft 14 makes direct contact with material to be mixed so that conduction heat transfer also occurs between shaft 14 outer surface and the material located around shaft 14.

Figure 4:
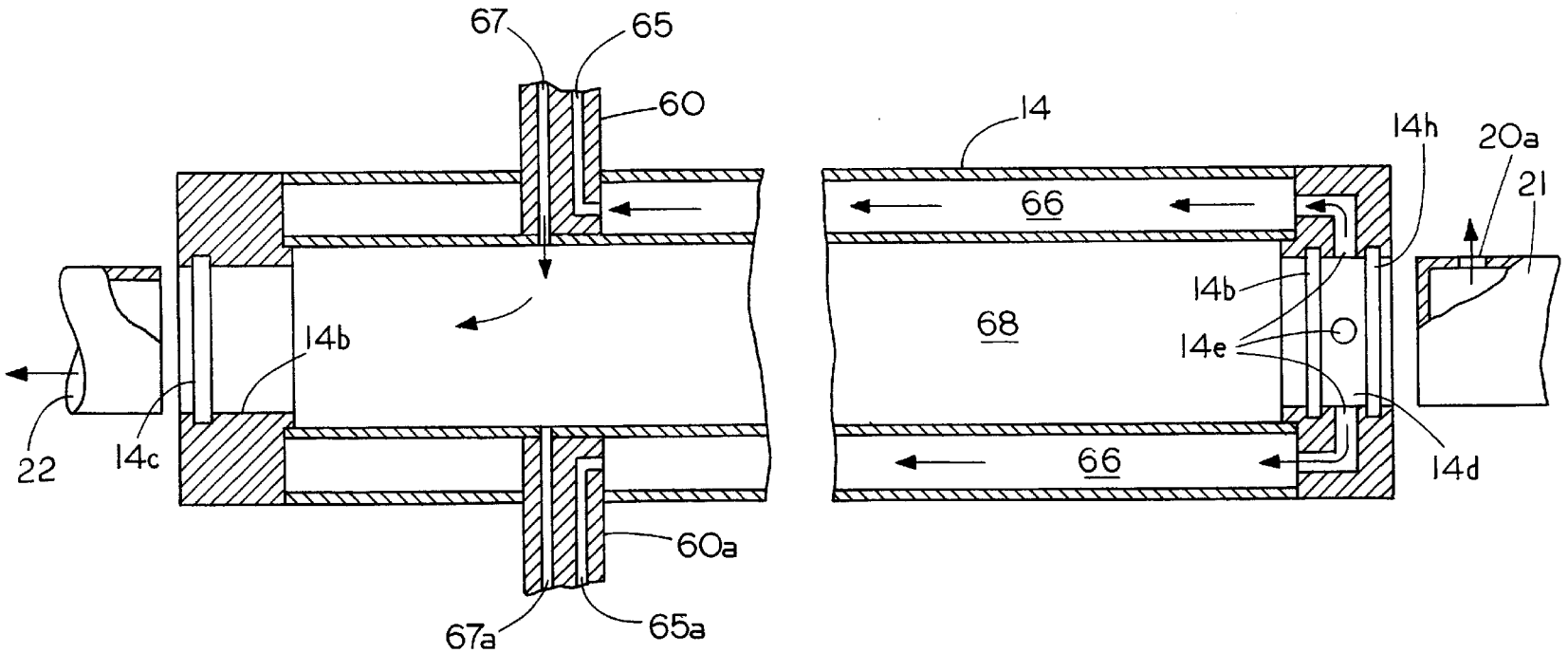
FIG. 4 is a cross sectional view of the shaft for supporting the mixing paddles.

A fluid passage 64 forms a restriction for fluid from chamber 62 to chamber 63 thus causing the fluid 9 to linger longer within chamber 62 so as to provide for a large area of heat transfer on paddle 14*a* In order to provide for rapid conduction transfer of heat between the material to be mixed and the heat transfer fluid it is preferred to have both the shaft 14 and the mixing paddles 14*a* of good thermal conducting material such as metal. Depending on the application, the metal can be selected so as to withstand the corrosives of material being mixed. A suitable metal usable in most applications is stainless steel. FIG. 4 is a cross sectional view of shaft 14 for cantileverly supporting mixing paddles thereon. For ease in illustration only two paddle connection rods 60 and 60 a are shown. Shaft 14 contains an annular inlet chamber 66 that directs a heat transfer fluid 9 to inlet 65 of rod 60 and inlet 65*a* of rod 60*a* The heat transfer fluid 9 then circulates through the paddle (as shown in FIG. 3) and then returns to central chamber 68 through outlet passages 67 and 67*a*. The fluid then discharges from chamber 68 into fluid conduit 22.

In the embodiment shown in FIG. 4 the conduit 22 normally fits in opening 14*b* and an annular groove 14*c* extends therearound so that when conduit 22 is inserted therein a sealing ring located in annular groove 14*c* contacts the exterior surface of conduit 14 to provide a rotatable seal thereabouts to permit rotation of shaft 14 about fluid conduit 22 while allowing fluid to flow through conduit 22. Similarly, on the opposite end fluid conduit 20, which is normally located in circular opening 14*d*, has a pair of ports 20*a* to allow the heat transfer fluid 9 to flow into chamber 66 through fluid inlets 14*e*. Opening 14*d* includes a pair of sealing recesses 14*g* and 14*h* for placing rotatable seals therein so that shaft 14 can be rotated about inlet conduit 20 while providing a seal around the end of conduit 20.

Figure 5:
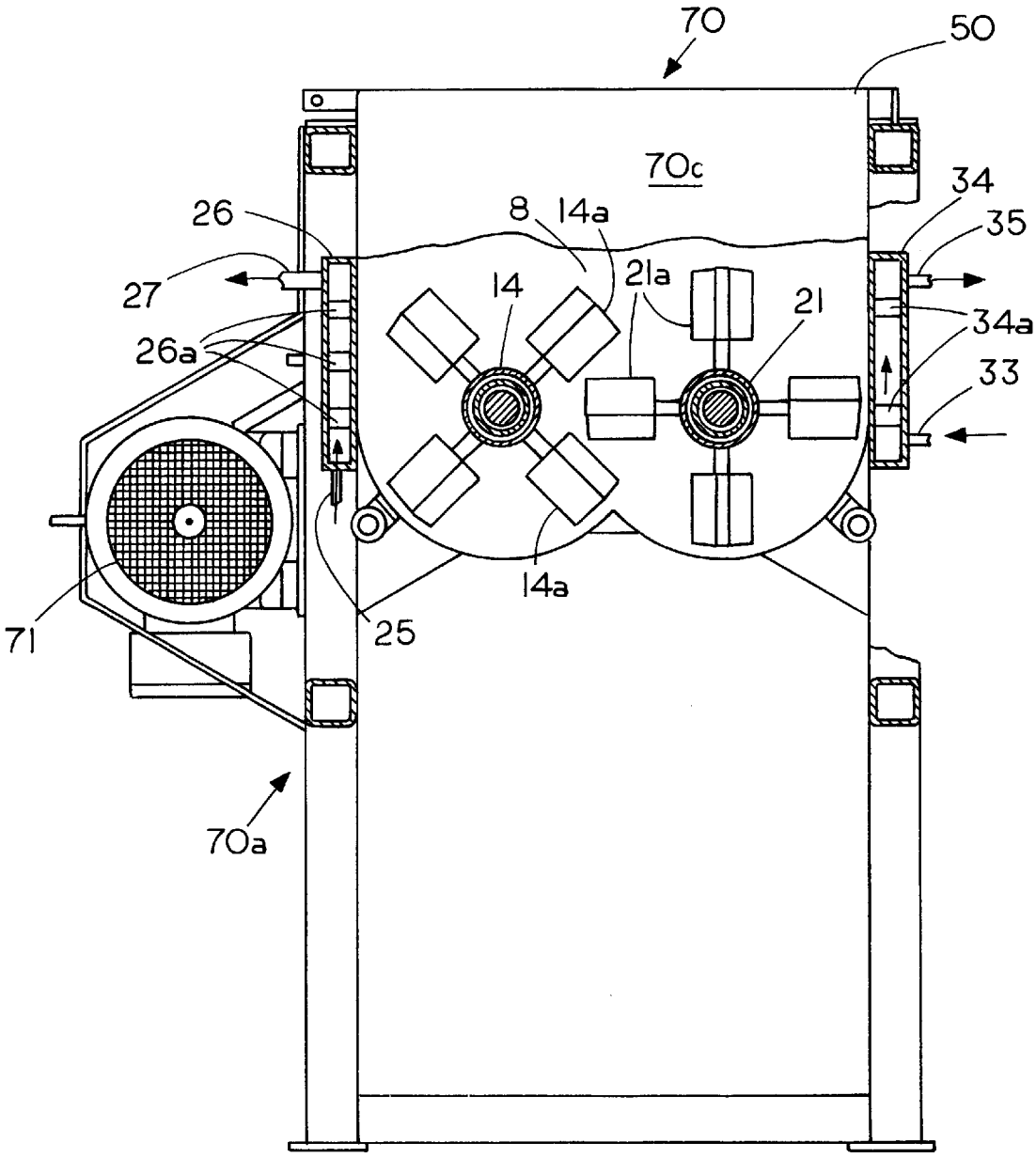
FIG. 5 is a cut-away end view of a mixer revealing the heat transfer jackets proximate the external sides of the hopper.

FIG. 5 is a partial cut-away end view of a mixer 70 revealing shafts 14 and 21 in cross section and showing heat transfer jackets 26 and 34, also in cross section, proximate the external sides of hopper 50. A motor 72 powers shafts 14 and 21 to rotate paddles 14*a* and 21*a* through a drive chain (not shown) to mix material 8 that is located in hopper 50. Heat transfer jacket 34 includes a plurality of fluid deflectors 34*a* and similarly heat transfer jacket 26 includes a plurality of fluid deflectors 26*a* to provide a tortuous path so that the heat transfer fluid extends over a wide area of the heat transfer jackets 26*a* for sufficient time so that heat can be conductively transfer over a wide area of heat transfer jacket 26. Material 8 which is to be mixed is shown located around paddles 14*a* and 21*a* and against the inside surface of hopper side walls and end walls.

Figure 6:
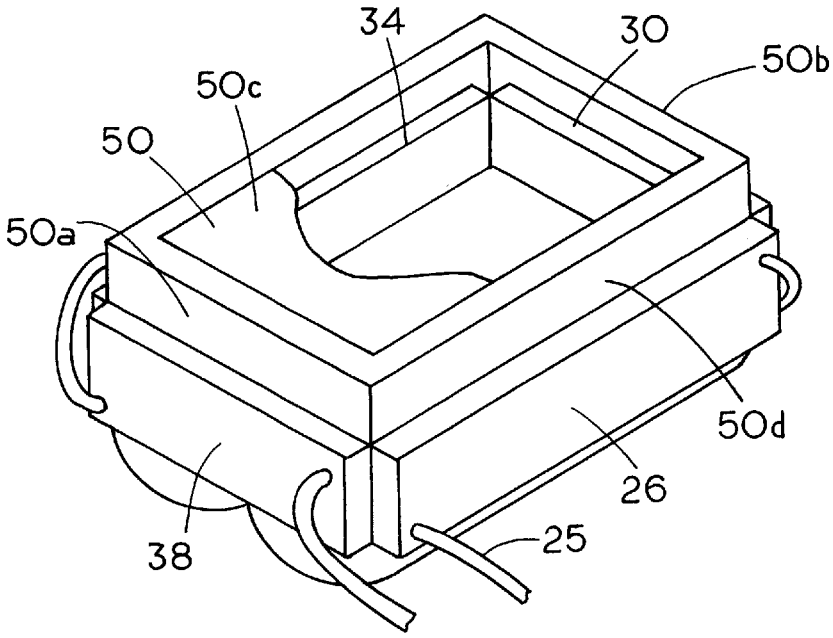
FIG. 6 is a partial perspective view to show the placement of the heat transfer jackets on the hopper.

FIG. 6 is a partial perspective view to show the placement of the heat transfer jackets 26, 30,34 and 38 in a circumferential position on end walls 50*a* and 50*b* and side walls 50*c* and 50*d*. It will be appreciated that the placement of the heat transfer jackets proximate the hopper walls provides a solid metal heat conduction path from the heat transfer jacket directly to the side of the hopper thereby providing for rapid transfer of heat from the heat transfer fluid 9. That is, the material 8 in the hopper 50 contacts the inside surface of the hopper 50 and the heat transfer fluid 9 contacts the outside surface of hopper 50 thereby providing a solid metal heat conduction path.

Figure 7:
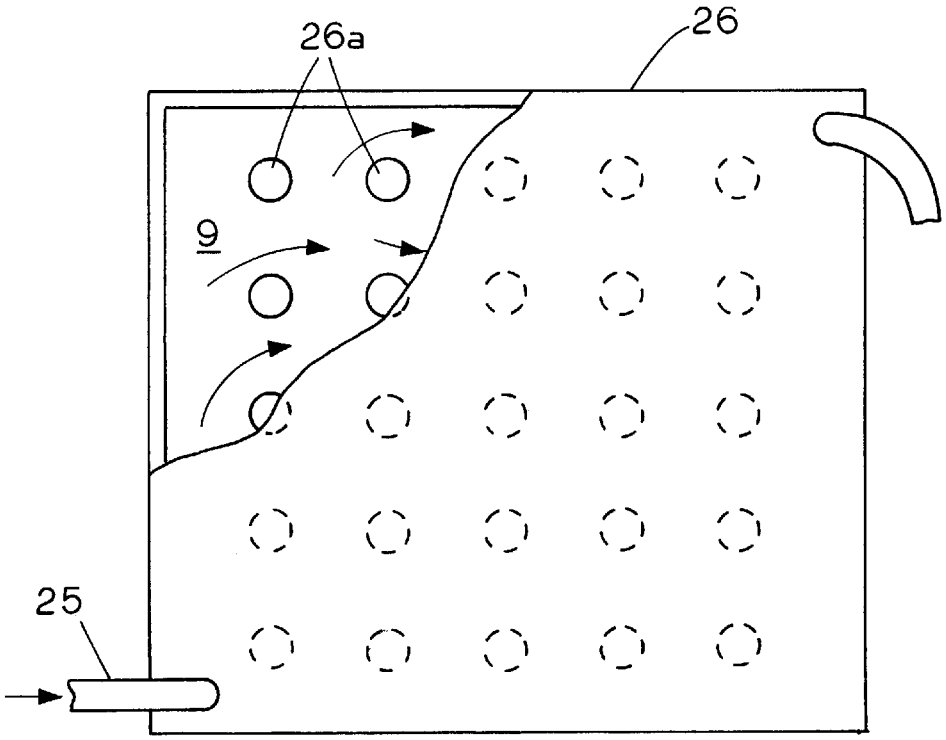
FIG. 7 is a partial cross sectional view showing the deflectors for deflecting the heat transfer fluid as it flows through the heat transfer jacket

FIG. 7 is a partial cross sectional view showing the fluid deflectors 26*a* for deflecting the heat transfer fluid 9 as it flows through the heat transfer jacket 26. Fluid deflectors 26*a* comprise a set of obstructions that the heat transfer fluid must flow around before the heat transfer fluid can be discharged from the heat transfer jacket 26. The arrows indicate the swirling and tortuous path followed by the heat transfer fluid 9 thereby distributing fresh heat transfer fluid 9 over the outside of the hopper 50 to provide an extended area for conduction heat transfer between the heat transfer fluid 9 and the side wall of the hopper In the method of the present invention one directs a material 8 at a first temperature into a hopper 50 while directing a heat transfer liquid 9 under pressure at a second temperature different from the first temperature through mixing paddles 14*a* and 21*a*. While the heat transfer liquid 9 flows through the mixing paddles one rotates the shaft 14 and 21 to simultaneously mix material 8 in hopper 50 while transferring heat through mixing paddles 21*a* and 14*a* and material 8. The paddles 21*a* and 14*a* conductively transferring heat between the mixing paddles outer surfaces and the material 8 to thereby change the temperature of the material 8 as the material is mixed. If greater heat transfer is needed one can include the additional step of directing heat transfer liquid 9 into a jacket 26, 30 34 or 38 located on hopper 50 to enable heat transfer liquid 9 to have greater surface contact with the material 8 and thus more quickly transfer heat between material 8 and said the heat transfer liquid. As the annular chamber 66 is located on the exterior portion of shaft 14 and 21 a conduction heat transfer path is also established through the shafts of the mixing machine 70*a*

If one wants to heat or dry the material 8 one maintains the temperature of the heat transfer liquid 9 above the temperature of the material 8 to be mixed to thereby quickly and simultaneously heat the material 8 as the material 8 is mixed.

Similarly, if one wants to cool the material 8 the heat transfer liquid 9 is maintained at a temperature below a temperature of material 8 to thereby quickly and simultaneously cool the material 8 as the material 8 is mixed.

Thus the conduction mixer includes a hopper 50 having a chamber 70*c* therein for receiving a material 8 to be mixed A mixing member, such as paddles 14*a* or the like is mounted in hopper 50 with the mixing member movable in hopper 50 to mix the material 8. As the material 8 is being mixed, a source 11 of heat transfer fluid 9 forces the heat transfer fluid 9 through the mixing member to thereby have the mixing member simultaneously mix and conductively transfer heat between the heat transfer fluid 9 and the material 8.

I claim:

1. A conduction mixer comprising:

a hopper;

a plurality of mixing paddles located in said hopper, said mixing paddles having a chamber therein with said chamber having a fluid inlet and a fluid outlet; said mixing paddles having at least two chambers therein with a restriction passage between said chambers to provide for the heat transfer liquid to linger in each of said two chambers;

a rotatable shaft, said rotatable shaft cantileverly supporting each of said plurality of mixing paddles thereon to permit rotation of each of said mixing paddles with said rotatable shaft, said rotatable shaft fluidly connected to said fluid inlet of each of said plurality of mixing paddles and fluidly connected to said outlet of each of said plurality of mixing paddles so that when a heat transfer liquid is forced through said rotatable shaft the heat transfer liquid flows through each of the plurality of mixing paddles to provide for conductive heat transfer between the heat transfer liquid and the plurality of mixing paddles so that said plurality of mixing paddles can simultaneously mix and conductively transfer heat; and a connecting rod, said connecting rod having a fluid passage located therein, said connecting rod connecting said mixing paddles to said rotatable shaft.

2. The conduction mixer of claim 1 wherein said hopper has a first and second side wall and a first and second end wall connected together and a heat transfer jacket located on each of said side walls and said end walls for conduction transfer of heat from the side walls and the end walls to a material located in said hopper.

3. The conduction mixer of claim 2 wherein each of the heat transfer jackets has an inlet and an outlet with the inlet and outlet of adjacent heat transfer jackets connected in a series so that the heat transfer liquid flows sequentially from one heat transfer jacket to another heat transfer jacket before being discharged from one of said heat transfer jackets, each of said heat transfer jacket having a plurality of fluid deflectors located within the heat transfer jackets for deflecting heat transfer fluids.

4. The conduction mixer of claim 3 wherein each of the inlets to the heat transfer jackets are located in a bottom section of the heat transfer jackets and each of the outlets are located in a top section of the heat transfer jackets.

5. The conduction mixer of claim 1 wherein the rotatable shaft includes a central chamber for directing heat transfer liquid away from each of said plurality of mixing paddles and an annular outer chamber for directing the heat transfer liquid into each of said mixing paddles.

6. The conduction mixer of claim 5 wherein the heat transfer liquid enters said rotatable shaft on a first end and discharges from said rotatable shaft on an opposite end.

7. The conduction mixer of claim 6 wherein the conduction mixer includes a second rotatable shaft with a set of mixing paddles cantileverly extending therefrom with said second rotatable shaft including a passageway for directing a portion of the heat transfer liquid from the first rotatable shaft through the second rotatable shaft to enable the portion of heat transfer liquid to conductively transfer heat to said second set of mixing paddles on said second rotatable shaft to thereby provide additional conduction heat transfer to the material in said hopper.

8. The conduction mixer or claim 1 wherein each of said mixing paddles have at least two chambers therein with a restriction passage between said two chambers to provide for the heat transfer liquid to linger in each of said two chambers.

9. The conduction mixer of claim 1 wherein each of the paddles are metal.

10. The conduction mixer of claim 1 when the rotatable shaft is metal.

11. The conduction mixer of claim 10 including a plurality of heat transfer jackets located on said hopper to thereby provide for heat transfer between the material to be mixed and a portion of heat transfer liquid directed into said heat transfer jacket, each of said heat transfer jacket having a plurality of fluid deflectors located within the heat transfer jackets for deflecting heat transfer fluids.

12. The conduction mixer of claim 11 including at least four heat transfer jackets with said heat transfer jackets positioned circumferentially around said hopper.

13. The conduction mixer or claim 12 wherein the at least four heat transfer jackets are connected in series so that the same portion of heat transfer liquid passes through each of said heat transfer jackets.

14. The conduction mixer of claim 1 wherein a source of the heat transfer liquid is connected to said conduction mixer.

15. The conduction mixer of claim 14 wherein the heat transfer liquid has a temperature higher than a temperature of the material to be mixed to thereby heat the material as the material is being mixed.

16. The conduction mixer of claim 14 wherein the heat transfer liquid has a colder temperature lower than a temperature of the material to be mixed to thereby cool the material as the material is being mixed.

17. A conduction mixer comprising:

a hopper, said hopper having a chamber therein for receiving a material to be mixed;

a mixing member, said mixing member mounted in said hopper, said mixing member movable in said hopper to thereby mix the material in said hopper; said mixing members having at least two chambers therein with a restriction passage between said chambers to provide for the heat transfer liquid to linger in each of said two chambers; and a source of heat transfer fluid, said source of heat transfer fluid connected to said mixing member by a connecting rod having a fluid passage located therein, said source of heat transfer fluid connected to said mixing member to direct the heat transfer fluid through said mixing member to thereby simultaneously mix and conductively transfer heat between the heat transfer fluid and the material to be mixed without the heat transfer fluid contacting the material to be mixed.

18. The conduction mixer of claim 17 wherein the source of heat transfer fluid includes a liquid having a temperature higher than a temperature of the material to be mixed to thereby heat the material during mixing thereof.

19. The conduction mixer of claim 17 wherein the source of heat transfer fluid includes a liquid having a temperature lower than a temperature of the material to be mixed to thereby cool the material during mixing thereof.

20. The method of condition mixing comprising the steps of:

directing a material at a first temperature into a hopper;

directing a heat transfer liquid at a second temperature different from said first temperature into a mixing paddle;

simultaneously mixing the material in the hopper with said mixing paddle while conductively transferring heat between the mixing paddle and the material to thereby change the first temperature of the material as the material is mixed, and directing a portion of heat transfer liquid into a jacket located on said hopper to enable said portion of heat transfer liquid to transfer heat between said material and said portion of heat transfer liquid.

21. The method of claim 20 including the step of directing a portion of heat transfer liquid into a jacket located on said hopper to enable said portion of heat transfer liquid to transfer heat between said material and said portion of heat transfer liquid.

22. The method of claim 20 wherein the heat transfer liquid is directed through a rotatable shaft supporting said mixing paddle.

23. The method of claim 20 wherein the heat transfer liquid is maintained at a temperature above the temperature of the material to be mixed to thereby quickly heat the material to be mixed.

24. The method of claim 20 wherein the heat transfer liquid is maintained at a temperature below a temperature of the material to be mixed to thereby quickly cool the material to be mixed.

25. The method of conduction mixing comprising the steps of:

directing a material at a first temperature into a hopper;

directing a heat transfer liquid at a second temperature different from said first temperature into a heat transfer jacket located proximate said hopper to form a direct heat conduction path from said heat transfer liquid to the material in the hopper; and simultaneously mixing the material in the hopper with a mixing paddle while conductively transferring heat between the hopper and the material and the paddle and the material to thereby change the first temperature of the material as the material is mixed without having the heat transfer fluid contact the material.

* * * * *